US008162463B2

(12) United States Patent
Jones et al.

(10) Patent No.: US 8,162,463 B2
(45) Date of Patent: Apr. 24, 2012

(54) SOLID INK STICK DELIVERY SYSTEM WITH STATIC CONSTRAINTS, STRATEGIC BARRIERS AND BREAKAGE CONTROL

(75) Inventors: Brent Rodney Jones, Sherwood, OR (US); Frederick T. Mattern, Portland, OR (US); Christopher Ryan Gold, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/051,403

(22) Filed: Mar. 18, 2011

(65) Prior Publication Data

US 2011/0164100 A1 Jul. 7, 2011

Related U.S. Application Data

(62) Division of application No. 11/900,352, filed on Sep. 11, 2007, now Pat. No. 7,909,445.

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | |
|---|---|---|---|
| 5,442,387 | A | 8/1995 | Loofbourow et al. |
| 6,213,600 | B1 | 4/2001 | Kobayashi et al. |
| 6,719,419 | B2 | 4/2004 | Jones et al. |
| 6,755,517 | B2 | 6/2004 | Jones et al. |
| D500,516 | S | 1/2005 | Jones et al. |
| 6,840,613 | B2 | 1/2005 | Jones |
| 7,066,589 | B2 | 6/2006 | Jones et al. |
| 7,631,963 | B2 | 12/2009 | Peters et al. |
| 7,824,027 | B2 | 11/2010 | Mattern et al. |
| 2005/0088499 | A1 | 4/2005 | Jones et al. |
| 2006/0279613 | A1 | 12/2006 | Jones et al. |
| 2007/0296779 | A1 | 12/2007 | Tidrick |
| 2007/0296782 | A1 | 12/2007 | Jones et al. |
| 2008/0088685 | A1 | 4/2008 | Lucas et al. |
| 2008/0151024 | A1 | 6/2008 | Jones et al. |
| 2008/0218569 | A1 | 9/2008 | Esplin et al. |
| 2008/0218573 | A1 | 9/2008 | Fairchild |
| 2008/0225096 | A1 | 9/2008 | Jones et al. |
| 2009/0066769 | A1 | 3/2009 | Jones et al. |

OTHER PUBLICATIONS

Non-Final Office Action for U.S. Appl. No. 11/900,419, Mailed Mar. 3, 2010, United States Patent and Trademark Office (8 pages).

Amendment in Response to Non-Final Office Action for U.S. Appl. No. 11/900,419, Submitted May 3, 2010 (9 pages).

*Primary Examiner* — Matthew Luu
*Assistant Examiner* — Rut Patel
(74) *Attorney, Agent, or Firm* — Maginot, Moore & Beck, LLP

(57) ABSTRACT

An ink delivery system of a phase change ink imaging device more effectively guides properly configured solid ink sticks from a first end of a feed chute to a melting device at a second end of the feed chute. The feed chute may include a sensor to detect coded sensor features on the properly configured solid ink sticks traveling along the feed chute and an obstructor configured to block improperly configured solid ink sticks inserted into the first end of the feed chute.

13 Claims, 10 Drawing Sheets

SOLID INK STICK DELIVERY SYSTEM WITH STATIC CONSTRAINTS, STRATEGIC BARRIERS AND BREAKAGE CONTROL

CLAIM OF PRIORITY

This application is a divisional application of and claims priority to commonly-assigned U.S. patent application Ser. No. 11/900,352, which is entitled "Solid Ink Stick Delivery System With Static Constraints, Strategic Barriers and Breakage Controls" to Jones et al., which was filed on Sep. 11, 2007 and which issues as U.S. Pat. No. 7,909,445 on Mar. 22, 2011.

CROSS-REFERENCE TO RELATED APPLICATIONS

Reference is made to commonly-assigned U.S. patent application Ser. No. 11/900,419, which is entitled "Solid Ink Stick with Anti Jam Edge Bevel" to Mattern et al., which was filed on Sep. 11, 2007, and which issued as U.S. Pat. No. 7,824,027 on Nov. 2, 2010, the entire disclosure of which is expressly incorporated by reference herein in its entirety.

TECHNICAL FIELD

This disclosure relates generally to phase change ink jet printers, the solid ink sticks used in such ink jet printers, and the load and feed apparatus for feeding the solid ink sticks within such ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

One problem faced in solid ink technology is differentiation and identification of ink sticks to ensure the correct loading and compatibility of an ink stick with the imaging device in which it is used. The wrong color of ink stick in a feed channel, ink sticks intended for different solid ink printers, use of non-qualified ink, etc. may impact image quality or even damage the solid ink imaging device. Provisions have been made to ensure that an ink stick is correctly loaded into the intended feed channel and to ensure that the ink stick is compatible with that printer. For example, the correct loading of ink sticks has been accomplished by incorporating keying, alignment and orientation features into the exterior surface of an ink stick. These features are protuberances or indentations that are located in different positions on an ink stick. Corresponding keys or guide elements on the perimeters of the openings through which the ink sticks are inserted or fed exclude ink sticks which do not have the appropriate perimeter key elements while ensuring that the ink stick is properly aligned and oriented in the feed channel. Another method that has been implemented to aid in the identification of an ink stick by a printer control system is the incorporation of encoding features into the exterior surface of ink sticks that interact with sensors in the ink delivery system. Ink stick data may be encoded into these features by configuring the features to interact with one or more sensors in an ink loader to generate a signal or coded pattern of signals that corresponds to information specific to the ink stick.

Emerging phase change ink jet technologies have reduced the time for generating solid ink images, and, consequently, have a high ink consumption rate. As a consequence, larger capacity solid ink delivery systems are needed. To increase the amount of ink that may be loaded in an ink delivery system, solid ink delivery systems have been provided with non-linear feed channels. Non-linear feed channels may include any number of linear and curved sections that can feed and guide ink sticks from an insertion end the ink delivery system to an ink melting assembly of the ink delivery system. The feed channels are typically at least partially enclosed in order to retain, orient, and guide the ink sticks along the feed path and to prevent ink debris in one channel from contaminating the other channels or the interior of the imaging device.

The increased capacity of solid ink delivery systems having non-linear feed channels has prompted the development and use of ink sticks having a larger length to width aspect ratio. The use of "longer" ink sticks lessens the frequency at which the solid ink in the ink delivery system has to be replenished. Larger ink sticks, however, may have greater fabrication stresses than smaller ink sticks due to the nature of the slow cooling rate of the ink and the difference in post forming shrinkage between the outer and inner ink volumes. Therefore, larger ink sticks may be more prone to breaking into multiple smaller pieces when mishandled. Broken ink sticks may not feed reliably resulting in undesirable skewing and jamming of the ink stick pieces in the feed channels.

In addition, increasing the size of the ink sticks may result in a corresponding increase in the tolerances for construction of the corresponding ink delivery system. These increased tolerances may lead to larger clearances around the keying, guiding, alignment, and/or orientation features as well as sensors in the solid ink delivery system. These enlarged clearances may allow undesirable skewing and jamming of the ink sticks in some ink feed channels as well as incorrect positioning of ink stick encoding features with respect to the corresponding sensors. Moreover, the increased clearances may allow the uncontrolled passage of smaller ink sticks and/or pieces of broken ink sticks to the melt assembly of the ink delivery system. If the smaller ink sticks or ink stick pieces are incompatible with the phase change ink jet printer in which they are being used, considerable errors and malfunctions may result.

SUMMARY

In order to address the needs associated with the previously known systems, a system for an ink loader is provided that improves feed control of ink sticks by optimizing the position of ink sticks with respect to ink sensing elements in an ink loader. The system comprises a feed chute having an insertion end and a melt end. An ink stick transport is configured to move at least one ink stick between the insertion end and the melt end of the feed chute. At least one sensor is positioned in the feed chute for detecting a coded sensor feature of the at least one ink stick moving along the feed chute between the insertion end and melt end. The system includes at least one nudger positioned in the feed chute that is configured to influence a position of the at least one ink stick moving along the feed chute so that the coded sensor feature of the at least one ink stick is in a sensing position with respect to the at least one sensor.

In another embodiment, a method of feeding ink sticks in an ink delivery system of a phase change ink imaging device comprises receiving at least one ink stick in a feed chute at an insertion end of an ink delivery system of a phase change ink imaging device, the at least one ink stick including a coded sensor feature for actuating at least one sensor in the feed chute. The at least one ink stick is moved toward a melt end of the feed chute. The moving ink sticks are nudged so that the coded sensor feature of the at least one ink stick is in a sensing position with respect to the at least one sensor in the feed chute. The coded sensor feature of the at least one ink stick is then detected with the at least one sensor.

In yet another embodiment, a system is provided that enhances feed control by allowing appropriately shaped and sized ink forms to be fed along a feed chute while impeding the passage of incorrect, out of date, mismatched ink shapes as well as broken ink stick sections. The ink delivery system comprises a feed chute having an insertion end and a melt end, and an ink stick transport for moving at least one ink stick between the insertion end and the melt end of the feed chute. An insertion opening is positioned at the insertion end of the feed chute that is sized to receive ink sticks having an insertion length. At least one pair of nudgers in the feed chute is beneath an area nearer the leading end of the insertion opening. An obstructor is positioned behind the at least one pair of nudgers. The at least one pair of nudgers is configured to position at least the leading end of ink sticks having an insertion length beyond the obstructor as the ink sticks having the insertion length are moved toward the melt end of the feed chute, and to allow ink sticks having a length less than the insertion length to be impeded from movement toward the melt end by the obstructor.

DETAILED DESCRIPTION OF THE PREFERRED EMBODIMENT

Figure 1:
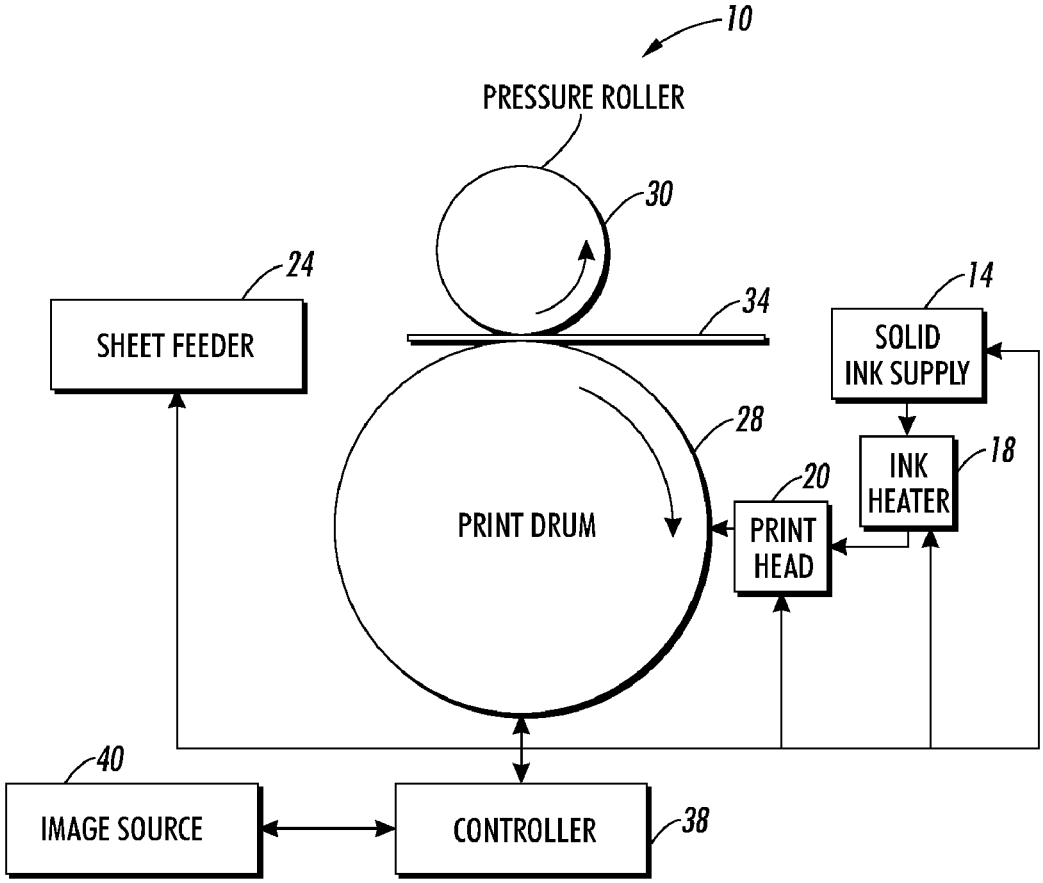
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present invention.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling all of the other machine subsystems and functions, including the machine's printing operations, and, thus, includes the necessary hardware, software, etc. for controlling these various systems.

Figure 2:
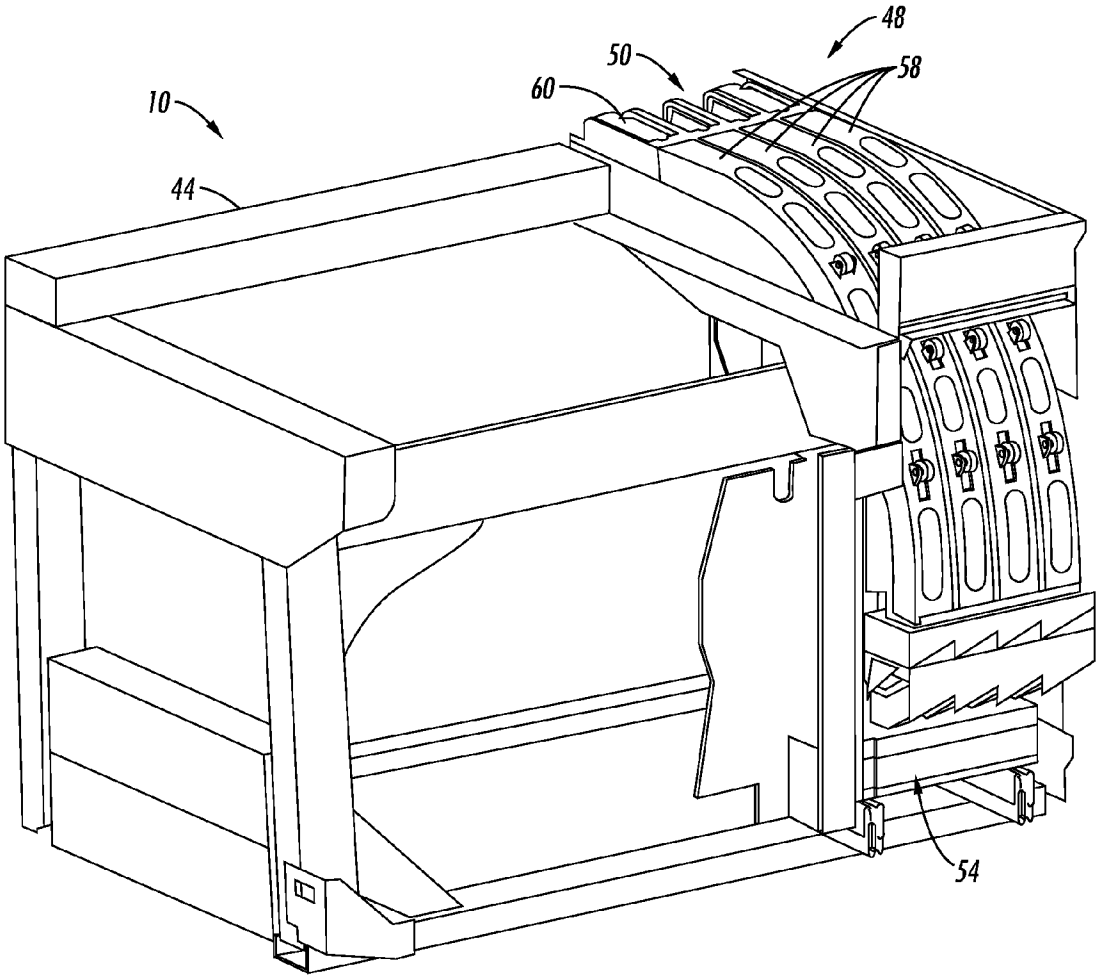
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The melting station 54 is configured to melt the solid ink sticks and supply the liquid ink to a printhead system (not shown). All forms of solid ink are referred to as ink sticks or simply ink or sticks. The ink delivery system 48 includes a plurality of channels, or chutes, 58. A separate channel 58 is utilized for each of the four colors: namely cyan, magenta, black and yellow.

The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc.

To better utilize the space within the imaging device 10, the feed channels 58 may have any suitable path for delivering ink sticks from the loading station 50 to the melt station 54. For example, the feed channels 58 may have linear and curved sections as needed to provide space for other components and to still deliver ink sticks from the loading station 50 to the melting station 54. An arcuate portion of the feed path may be short or may be a substantial portion of the path length. The full length of the chute may be arcuate and may consist of different or variable radii. A linear portion of the feed path may likewise be short or a substantial portion of the path length. All or at least a portion of the feed channels are enclosed by a confining wall. The confining wall aids in guiding, orienting, and/or aligning ink sticks as they travel from the loading station to the melting station, and prevents ink debris from escaping the respective feed channels to contaminate the other feed channels and the interior of the imaging device.

The depicted solid ink delivery system 48 includes a drive member (not shown) for moving one or more ink sticks 68 along the feed path in the respective feed channel 58. A separate drive member may be provided for each respective feed channel. The feed channel 58 for each ink color retains and guides ink so that the ink progresses along a desired feed path. The drive member, if utilized, may have any suitable size and shape. The drive member may be used to transport the ink over all or a portion of the feed path and may provide support or guidance to the ink and may be the primary ink guide over all or a portion of the feed path. As explained in more detail below, feed channels may include static constraints and/or strategic barriers to ensure reliable feeding of properly configured ink sticks and to prevent or impede the passage of broken or improperly configured ink sticks and may employ gravity as a feed force or influence.

Figure 3:
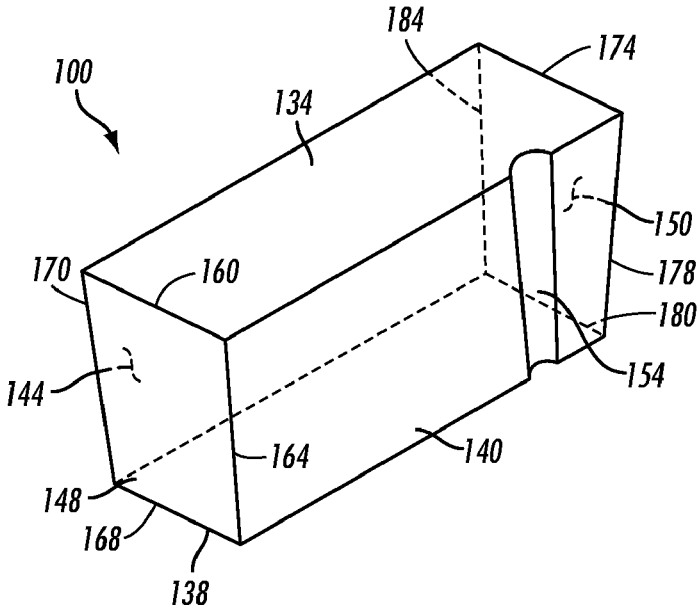
FIG. 3 is a perspective view of one embodiment of a solid ink stick.

An exemplary solid ink stick 100 for use in the ink delivery system 20 is illustrated in FIG. 3. The ink stick has a bottom surface 134 and a top surface 138. The particular bottom surface 134 and top surface 138 illustrated are substantially parallel to one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel to one another, and are substantially perpendicular to the top and bottom surfaces 134, 138. The end surfaces 148, 150 are also basically substantially parallel to one another, and substantially perpendicular to the top and bottom surfaces, and to the lateral side surfaces. One of the end surfaces 148 is a leading end surface, and the other end surface 150 is a trailing end surface. The leading end 148 and the side surfaces 140, top surface 134 and bottom surface 138 meet to define a plurality of leading edges 160, 164, 168, 170, and the trailing end 150 and the side surfaces 140, top surface 134 and bottom surface 138 meet to define a plurality of trailing edges 174, 178, 180, 184.

Figure 4:
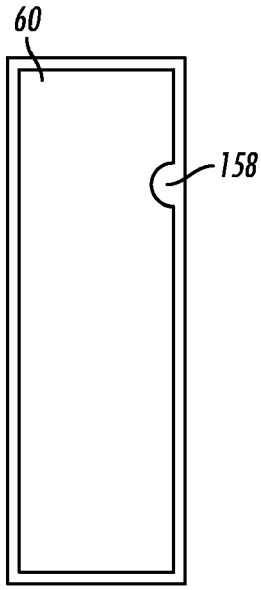
FIG. 4 is a top view of a keyed opening of the ink delivery system.

Ink sticks may include a number of features that aid in correct loading, guidance and support of the ink stick when used. These features may comprise protrusions and/or indentations that are located in different positions on an ink stick for interacting with key elements, guides, supports, sensors, etc. which are located in complementary positions in the ink loader. For example, FIG. 3 shows an embodiment of an ink stick that includes insertion keying features 154. The stick keying features interact with the keyed openings 60 of the loading station 50 to admit or block insertion of the ink sticks through the insertion opening of the solid ink delivery system 48. In the ink stick embodiment of FIG. 3, the key element 154 is a vertical recess or notch formed in side surface 140 of the ink stick body. The corresponding complementary key 158 on the perimeter of the keyed opening 60 is a complementary protrusion 158 into the opening 60 (See FIG. 4). Any number or shape of key features may be employed in any suitable position on the ink stick.

Due to the high ink consumption rates that are possible with phase change ink imaging devices, the ink stick 100 may have an aspect ratio in which the longitudinal length of the ink stick body between the leading end 148 and the trailing end 150 is significantly greater than the width and/or height of the ink stick body between the lateral side surfaces 140 and the height of the ink stick body between the top surface and the bottom surface. The longitudinal length of the ink stick body is typically the dimension that is substantially aligned with the feed direction of a feed channel. The width and height of the ink stick are perpendicular to the length. The ratio of the length of the ink stick body to the width and/or height may depend on a number of factors such as aesthetics, fabrication, loader orientation and/or functional requirements. Size and aspect ratio descriptions of the stick and loader feed channel used above are useful in visualizing and appreciating the features of the present invention but are not intended to be limitations to the embodiments incorporating these and related functions.

Figure 5:
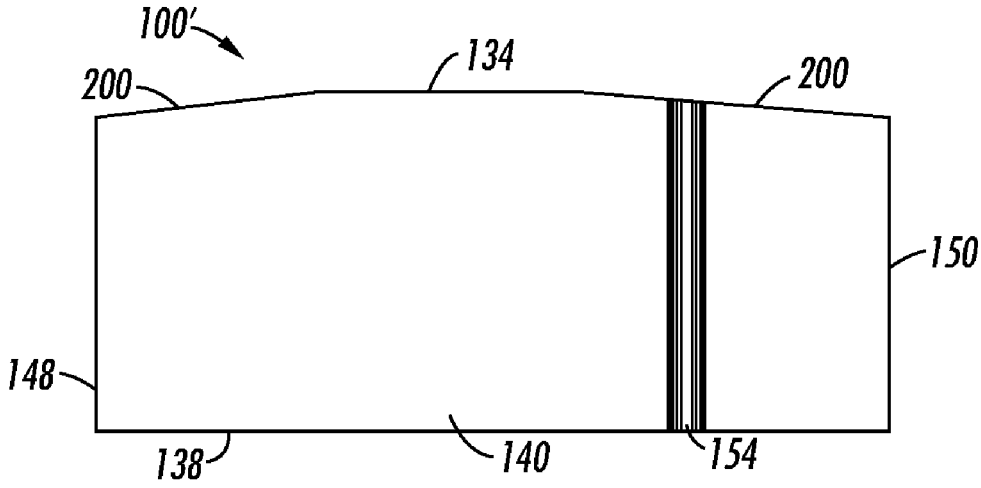
FIG. 5 is a side view of an embodiment of an ink stick that includes clearance edges.
Figure 6:
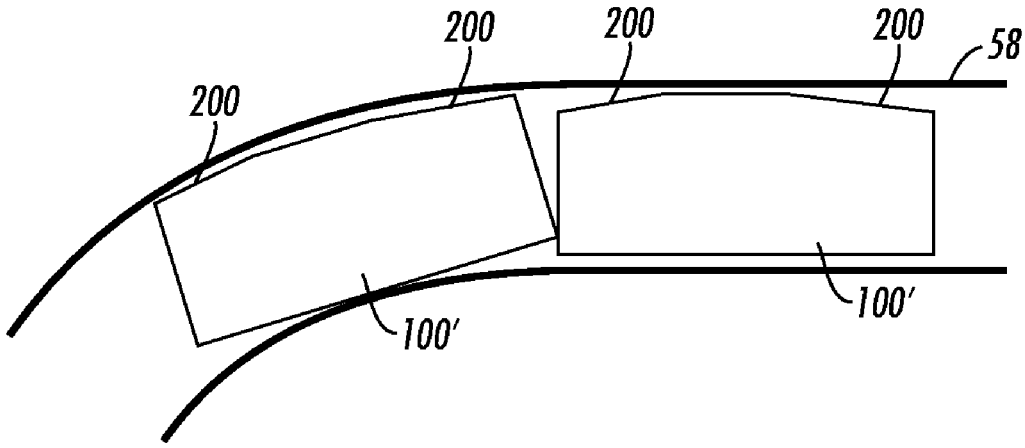
FIG. 6 is a side view of a feed channel in which a pair of ink sticks having clearance edges are shown being fed.

As mentioned above, the feed path defined by the feed channel may include linear as well as arcuate, or curved sections. In order to facilitate the movement of longer sticks along the curved portions of the feed path, one or more of the leading edges 160, 164, 168, 170 and/or trailing edges 174, 178, 180, 184 of an ink stick may be configured as clearance edges 200 as shown in FIG. 5. As shown in FIG. 6, clearance edges 200 enable ink sticks 100' to clear the confining walls of the feed channel 58 as the ink sticks progress through curved sections of the feed channel 58 as well as through transition areas between linear and curved sections of the feed channel. In one embodiment, a clearance edge 200 comprises a reduced edge that is angled or shaped to complement the contour of the confining walls in the non-linear sections of a feed channel. Clearance edges 200 are configured to provide spacing between the edges of the ink stick and the walls of the feed channels as the ink sticks transition into and out of the curved sections of the channel. The clearance edge may be a beveled or chamfered edge, a rounded edge, or have any suitable combination of these or other contours. The clearance edges on the ink stick enable longer sticks to pass through a feed channel having linear and curved sections without drastically reducing the ink volume of the stick. The clearance edge or chamfer, defined here as an angle, bevel, radius or contour or combination of such features, is more significant in prominence than a similar feature used in molding, forming, machining or other fabrication artifacts or enablers, such as a drafted surface, deformation or small radius.

The edges of the ink stick that are selected to be treated or contoured to form clearance edges and the degree to which the edges are reduced depends on the configuration of the ink and feed channel, and, in particular, the direction of the vector change in the non-linear sections of the channel. For example, in a feed channel that includes a transition from a linear section to a downwardly arced section, such as the feed channels shown in FIG. 6, clearance edges 200 may be formed at the leading end 148, the trailing end 150 or both to facilitate forward and/or reverse feed of the ink sticks between the insertion station and the melt station. In embodiments of feed channels that include horizontally curved sections (e.g. curve to the right and/or left), ink sticks may include clearance edges at the leading end and/or trailing end adjacent the corresponding side surfaces. Any suitable number of edges of ink sticks may be configured as clearance edges. For example, ink sticks configured for use in a feed channel having both vertically and horizontally curved sections may include clearance edges adjacent the top surface and side surfaces. Clearance edges may be contoured across the entire width of the edge or only portions of the edge which have potential for contact with confining surfaces of the feed channel. Another of the many possible configurations would be an upward incline where the bottom edge of the stick is beveled or shaped to complement the upward path transition.

In other embodiments, feed channels may be equipped with static constraints at one or more strategic positions in the feed channels that are configured to gently contact, or nudge, ink sticks into optimal alignment or positioning within the feed channel as the ink sticks are fed along the channels. These static constraints, also called nudgers or positioners, may comprise rollers, ribs, gussets, flexures, rails or similar structural forms that may be placed at any suitable position in a feed channel or adjacent a feed path in order to influence alignment and/or orientation of moving ink sticks. For example, static constraints may be placed at the top, bottom, and sides of a feed channel as well as interfaces between these surfaces, and may be employed at multiple surfaces in a given area. In addition, multiple static constraints may be utilized in unison in a feed channel, and each may have the same or different configuration. A proper ink stick progressing in the nominally ideal path of the feed chute need not be position influenced. The static constraints that nudge an out of location stick would not typically contact the well positioned stick so as to not increase friction or resistance to intended transport. The static constraint or nudger benignly acts upon an ink stick when contact is made by a stick that needs to be coaxed into a more optimal position to facilitate sensing or to benefit feed progress. The nudger may influence the ink stick position as it is being inserted and/or at one or more locations as it feeds along the chute. Transport of the ink from insertion to melt ends of the chute may be facilitated by a conveying or pushing means or by gravity or by any combination of such force inducing methods and the motion enabled by such force influence also enables the ink stick repositioning function of the nudger. The static constraint may be anchored in location but still be movable, such as with a pivot, flexure or constrained displacement, to aid in nudging the ink stick as intended.

Ink loader geometry may influence the optimal locations for the placement of static constraints. For example, in a feed channel that includes a transition from a linear section to a downwardly arced section, nudgers may be positioned near the top surface of the feed channel where the ink sticks naturally deviate from the straight line path. Similarly, nudgers may be positioned at the lateral sides of the channel if the channel curves horizontally to the right or left. Even in situations where the feed channel is substantially straight, ink sticks may veer from a straight line path due to loader orientation in the imaging device, by feed enhancement or drive features within the loader, by localized thermal influence external to the loader, or by air flow, motion or vibration caused by other working elements within the imaging device, many of these influencing a tendency for ink sticks to move out of ideal alignment or position regardless of the loader orientation or a feed path section relative to gravity.

Figure 7:
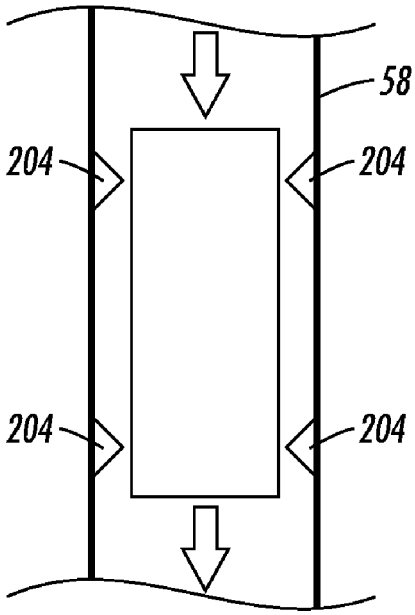
FIG. 7 is a top view of a portion of an embodiment of a feed channel that includes strategic constraints.

FIG. 7 shows a top view of a portion of a feed channel that includes multiple nudgers 204 for ensuring that ink sticks are substantially aligned to the desired position along a feed path of the feed channel. In this embodiment, two opposing pairs of nudgers 204 are utilized. Although the nudgers are shown in opposing pairs, they might be utilized on a single side of the feed channel, depending on the movement tendencies of a given feed channel and ink stick configuration. The distance between corresponding nudgers on opposing sides of the feed channel is slightly greater than the width of the ink stick so as to allow passage of ink sticks therebetween. In this embodiment, although not required, the distance between the nudgers that are positioned along the same lateral surface is less than the longitudinal length of the ink stick so that the leading end and trailing end of ink sticks may be aligned simultaneously. The nudgers 204 depicted in FIG. 7 comprise ramp-like structures that extend from the lateral walls of the feed channel. Each ramp structure 204 is angled on both sides to provide a guiding surface for gently nudging ink sticks toward the nominal feed path of the feed channel 58. The ramps may be angled on both sides so that ink sticks may be moved in either direction along the feed path. Although ramp-like structures are depicted, other configurations of nudgers may be implemented such as rollers or angled webs or gussets. In addition, nudgers may be compliant, flexible, spring loaded or otherwise biased to lessen the "impact" and/or friction of contact between the nudgers and ink sticks. Nudgers may extend from sides, top, bottom or other surfaces and structures or combinations of such in or about the feed channel. Pairs of nudgers may be aligned or not aligned at points along the length of the chute at opposite sides where opposite sides may be left-right, top-bottom and front-back, or any combination thereof, depending on the orientation of the loader.

The configuration of nudgers illustrated in FIG. 7 may be positioned at substantially any portion of a feed channel. For example, in one embodiment, nudgers may be positioned along the feed channel proximate the insertion station to align and/or orient ink sticks to ensure reliable feed after insertion. Similarly, nudgers may be positioned proximate the melt station to ensure that ink sticks are aligned properly for contact with an ink melter at the melt station. In another embodiment, nudgers may be positioned periodically along the entire length of the feed path.

Figure 8:
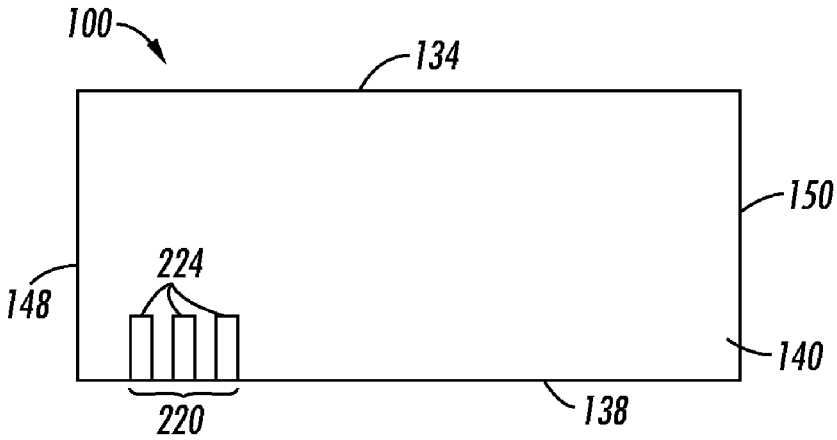
FIG. 8 is a side view of an embodiment of an ink stick that includes a coded sensor feature.

Nudgers may also be beneficial in ensuring that encoding features of ink sticks are in optimal alignment or position to interact with corresponding sensors in the feed channel. Referring now to FIG. 8, an embodiment of an ink stick is shown that includes a coded sensor feature 220 for encoding variable control information or attribute information into the ink stick 100. The coded sensor feature 220 is formed in a predetermined location on the ink stick 100 and is configured to actuate one or more sensors in the feed channel of the ink delivery system. Coded sensor feature 220 may include one or more sensor actuating elements 224 that may be curved, spherical, angled, square or any shape that permits reliable sensor actuation, directly or indirectly, such as by moving a flag or actuator or by reflecting or blocking light in an optical sensing system. The coded sensor feature 220 is shown on the side surface 140 of the ink stick 100 although the coded sensor feature 220 may be formed on any surface or more than one surface of the ink stick. The sensor features may be adjacent one another or may be in multiple locations.

The coded sensor feature 220 of an ink stick is configured to actuate sensors in the feed channel to generate one or more encoded signals that may be received by the controller and translated into control information pertaining to the ink stick. The encoded control information may be used by a control system in a suitably equipped solid ink jet printer to control print operations. For example, an imaging device control system may receive and translate the code word into the appropriate control and/or attribute information pertaining to the ink stick and may then enable or disable operations, optimize operations or influence or set operation parameters based on this decoded information. Ink sticks that are not properly aligned and/or oriented as they are fed along a feed channel may not pass close enough or perhaps may be too close to a sensor for proper reading of the coded sensor feature of the ink stick. An ink stick may be adjacent at least one sensor when placed in the insertion position where it may then be acted upon by the one or more sensors. The sensor and/or stick may be in a stationary or moving state as the ink stick is acted upon or identified by the sensor.

If the coded signal generated by the coded sensor feature indicates that the ink stick is compatible or configured for use with the feed channel, normal operations may continue. If the coded signal indicates that the ink stick is not configured for use with the feed channel, the controller may halt printing operations, issue a control panel message or other such action. In this case the controller determination of ink suitability may result in any number of responses of the imaging device system, including disabling the transport, moving it for optimal removal or examination of the ink stick, issuing user messages, prompts or warnings, initiating network communications and so forth. In one embodiment, the controller may be configured to halt operations when an incompatible, unrecognized or damaged ink stick is detected by disabling the drive member to ensure that the ink stick is not delivered to the melt plate.

Figure 9:
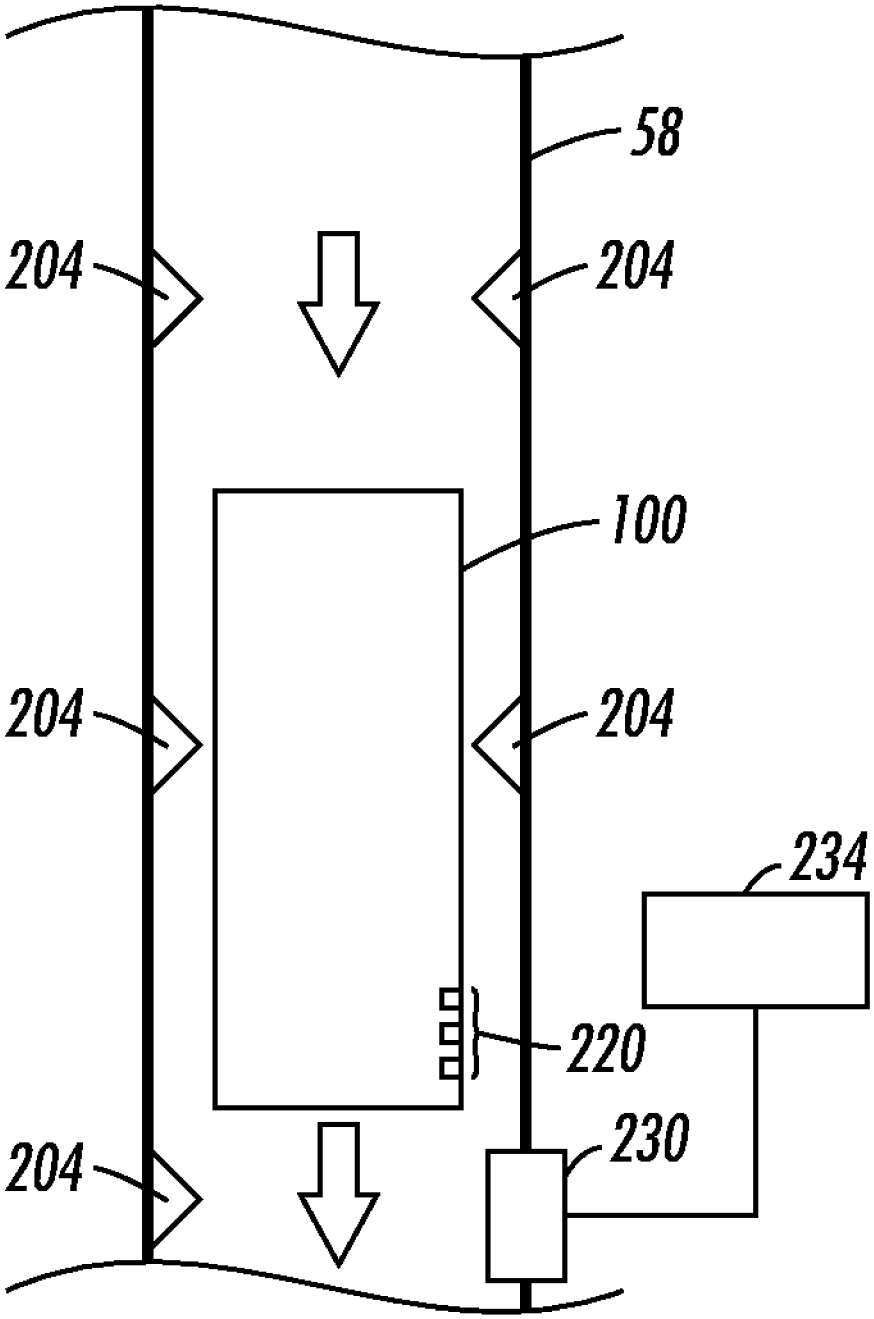
FIG. 9 is a top view of an embodiment of a feed channel that includes a sensor system for reading a coded sensor feature of the ink stick of FIG. 8 and strategic constraints for controlling positioning of the ink stick in relation to the sensor system.

To ensure reliable reading of the coded sensor features of ink sticks, feed channels may include nudgers to act as constraining guides to position and/orient the ink sticks correctly as they are fed past corresponding sensors in the feed channel. FIG. 9 shows an embodiment of a feed channel 58 that includes a sensor system 230 designed to interface with the coded sensor feature 220 of the ink stick 100 and nudgers 204 for ensuring the ink sticks are positioned optimally with respect to the sensors of the sensor system 230. The sensor system 230 may include a flag or an optical sensing system configured to detect the coded sensor feature, and for generating a signal that is output to a controller 234. The sensor system 230 is positioned along a lateral side of the feed channel near the bottom of the feed channel. Nudgers 204 are positioned on opposing sides of the feed channel to control the alignment and/or orientation of the ink stick so that the coded sensor feature 220 may pass at a desired distance from the sensor system. In this embodiment, the nudgers 204 comprise ramp structures similar to the ones shown in FIG. 7, although any suitable type of nudger may be used. The nudgers are configured to contact the ink stick gently as it is fed along the channel to urge the ink stick into a position in which the coded sensor feature of the ink stick may actuate (or not actuate) the sensor flag. Any suitable number and/or configuration of nudgers may be implemented. An ink stick ideally positioned as it nears and passes a nudger need not actually contact a nudger where its purpose is to position a stick to a nominal location or path.

Nudgers 204 are generally configured to ensure the reliable feeding and sensing of correctly configured compatible ink sticks in the imaging device. As mentioned above, broken ink sticks and/or smaller ink sticks may not be properly influenced by the static constraints and other feed control protocols that may be incorporated into the feed channel. If smaller ink sticks are inserted that are incompatible with the phase change ink jet printer in which they are being used or if an ink stick has broken into pieces, severe jams may occur and considerable errors and malfunctions may result. Therefore, in addition or as an alternative to the static constraints described above, feed channels may include strategic barriers that are configured to prevent the passage of incorrectly configured ink sticks and to inhibit the passage of broken sections of ink sticks.

Figure 10:
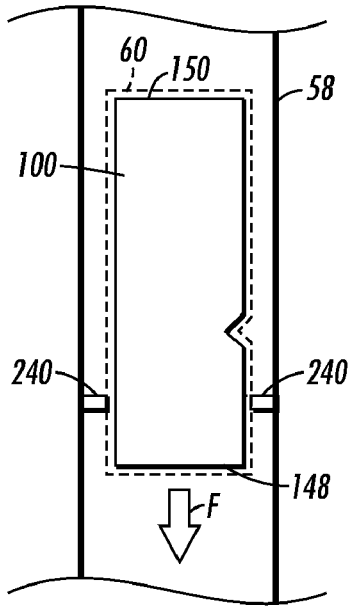
FIG. 10 is a top view of an insertion area of an embodiment of a feed channel that includes strategic barriers and the interaction of the strategic barrier and a correctly configured ink stick.
Figure 11:
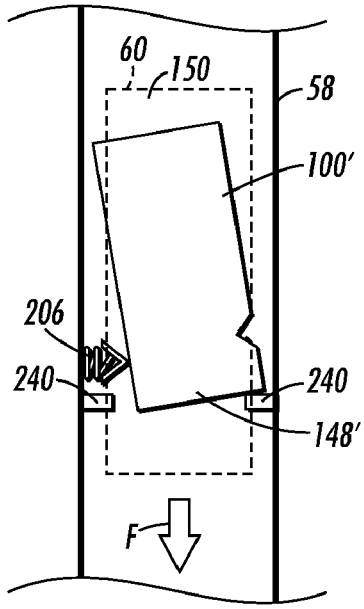
FIG. 11 is another top view of the insertion area of the embodiment of the feed channel of FIG. 10 that includes strategic barriers and the interaction of the strategic barrier and an incorrectly configured ink stick.

Strategic barriers may comprise rollers, gussets, protrusions or similar elements that may be placed as needed in the feed channel to impede the passage of improperly configured and/or shaped ink sticks. As an example, FIG. 10 shows an embodiment of a strategic barrier 240 that is incorporated in the insertion area of the feed channel 58 beneath the keyed opening 60. In this embodiment, the strategic barrier 240 comprises at least one protrusion that is positioned adjacent the bottom side surface of the feed channel 58 a short distance behind where the front, or leading end 148, of a properly configured/shaped ink stick would come to rest after insertion. As shown in FIG. 10, the leading end 148 of ink sticks having the proper length for insertion through the keyed opening 60 extends beyond the strategic barrier 240 after insertion, and, therefore, may not catch on the barrier 240 as the ink stick 100 is moved forward in the feed direction F as shown in FIG. 10. Conversely, as shown in FIG. 11, the leading end 148' of shorter ink sticks or ink stick pieces 100' may not be guided past the barrier 240 after insertion, and, consequently, may be caught on the barrier 240 as the ink stick 100' is moved forward thereby preventing passage of ink sticks that may not be configured for use with the imaging device. Broken pieces or non-optimized ink stick configurations generally would not feed in an ideal path and when off axis have a higher chance of being obstructed. As shown in FIG. 11, a flexible or movable nudger 206 that intrudes somewhat into the ink feed path can be used to nudge an ink stick leading end toward a barrier if the stick is too short to be held to the nominal feed path by other nudgers, guides or feed path features that would simultaneously act on an appropriate length and shaped ink stick. The movable nudger 206 would be pushed aside by a stick being adequately guided or positioned by additional features intended to do so, such as multiple or strategically placed nudgers. The barrier 240 is not expected to positively inhibit feed of all incorrect or broken stick pieces.

Figure 12:
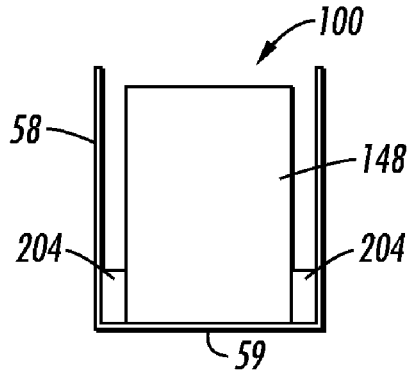
FIG. 12 is a front view of an embodiment of a feed channel insertion area that includes static constraints and strategic barriers.
Figure 13:
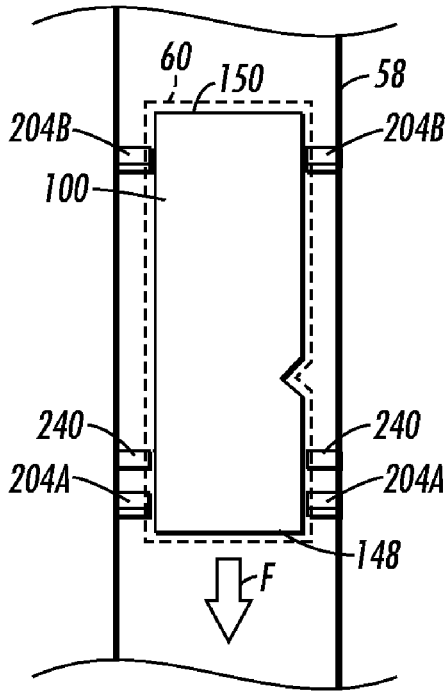
FIG. 13 is a top view of the embodiment of the feed channel of FIG. 12.

Strategic barriers may be placed at any or multiple locations along the feed path, and may be used in conjunction with static constraints. FIGS. 12 and 13 show an embodiment of a feed channel 58 that incorporates both static constraints 204 and strategic barriers 240. In this embodiment, a first pair 204A of opposing static constraints is positioned near where the front, or leading end 148, of a properly configured/shaped ink stick 100 comes to rest after insertion, and a second pair 204B of opposing static constraints is positioned near where the back, or trailing end, of the properly configured ink stick comes to rest after insertion. The strategic barrier 240 is positioned behind the first pair of static constraints 204A. The static constraints may comprise rollers, angled gussets, etc.

that are configured to maintain an ink stick slightly inboard of these constraints as the ink stick 100 is moved forward. As shown in FIG. 13, an ink stick 100 having the proper length for insertion through the keyed opening 60 may be positioned within the static constraints 204 at each end of the ink stick 100. The static constraint 204 is configured to extend very near the surface of an ideally positioned ink stick supported by a guide, conveyance member or other bottom support feature or surface. The constraint feature(s) would not normally become a support for the ink stick but may on occasion contribute to support as they engage a stick in a nudging fashion. Strategic barrier feature(s) have a more abrupt, blocking configuration with respect to interface with an ink stick but would not generally influence a stick in the nominal feed path. Therefore, the strategic barrier 240 of FIG. 13 is not in a position to impede the passage of a properly configured ink stick. Ink sticks that do not have the proper length or width are not properly positioned along the nominal feed path and may gravitate or be directed toward a barrier after insertion. Consequently, the improperly configured ink sticks may be caught on the barrier as the ink stick is moved forward.

Figure 14:
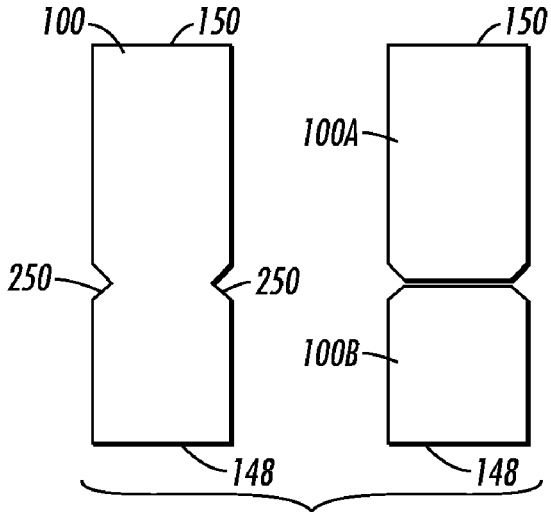
FIG. 14 is a top view of an embodiment of ink stick that includes breakage control features.

Larger ink sticks such as the ink stick shown in FIG. 3 may be more prone to breaking into pieces when mishandled or dropped than smaller ink sticks. Broken pieces of ink sticks generally may not feed reliably. Therefore, another feature that may be incorporated into ink sticks is a breakage control feature. Referring to FIG. 14, a breakage control feature comprises one or more subtle notches 250 or similar features placed at one or more locations on the ink stick 100 that are configured to control or influence the position where the ink stick breaks when mishandled. The break location may thus be somewhat predictable even though the configuration of break surfaces would vary undeterministically. It is expected that the major broken sections or pieces would be similarly predictable to the extent that the break may typically result in two pieces as opposed to an unknown several. Breakage control features 250 may be positioned anywhere on the ink stick, but may be beneficially positioned at weak or vulnerable locations that are most affected by internal fabrication stress or at points most complementary to feed control objectives for a particular system. This feature 250 facilitates a cleaner break of the ink stick 100 into separate ink stick sections 100A, 100B. Thus, breakage control features 250 enable some predictability of the size of ink stick pieces that may be inserted into a feed channel so that feed control features such as static constraints and/or strategic barriers may be more effective.

Figure 15:
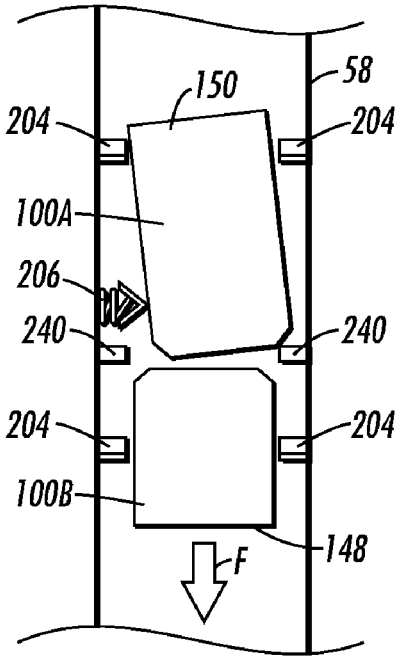
FIG. 15 is a top view of the insertion area of the embodiment of the feed channel of FIG. 12 that shows the interaction of the static constraints and strategic barriers with an ink stick fractured in accordance with the breakage control feature.

FIG. 15 illustrates how the static constraint/strategic barrier system as depicted in FIG. 13 may be used with an ink stick having a breakage control feature 250. As can be seen, the ink stick is broken at the breakage control feature into sections 100A and 100B. The ink stick may have been broken before or after insertion. In any case, the strategic barrier 240 is positioned so that it is in front of the breakage control feature 250 after the ink stick is inserted. Therefore, the leading end 100B of the ink stick, having been controllably separated and of a known size, may be allowed to progress through the feed channel 58. The rear portion 100A of the ink stick may be caught by the barrier 240. Although not necessary, a flexible or movable nudger 206 may be used to nudge the leading end of the rear portion 100A of the ink stick toward the barrier 240. Reducing the likelihood of the rear broken section to feed forward along with the leading section is an aid to preventing the two sections from creating a wedge at the break interface that would impede predictable feed performance along some portion of the feed path where that location may otherwise be unpredictable.

Figure 16:
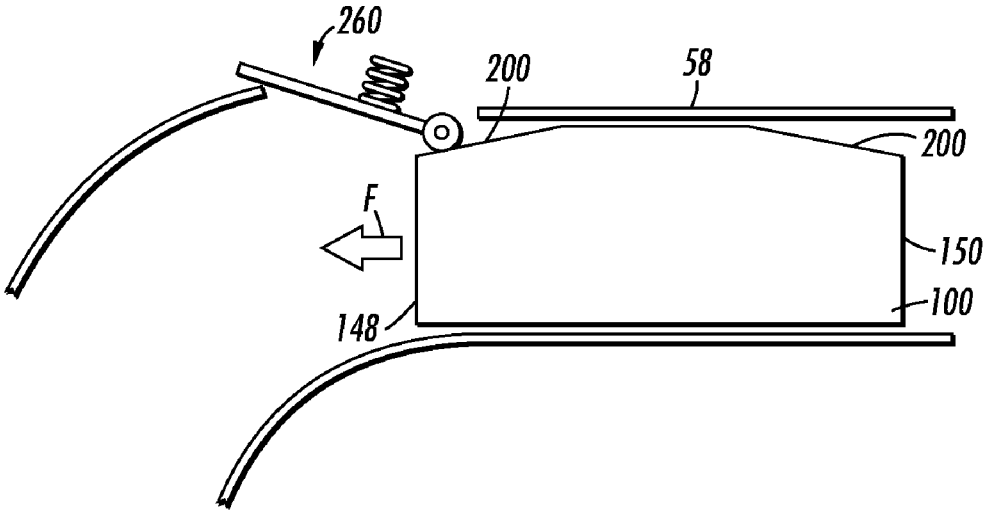
FIG. 16 is a side view of a feed channel that includes a combination barrier/constraint in the form a spring loaded roller.
Figure 17:
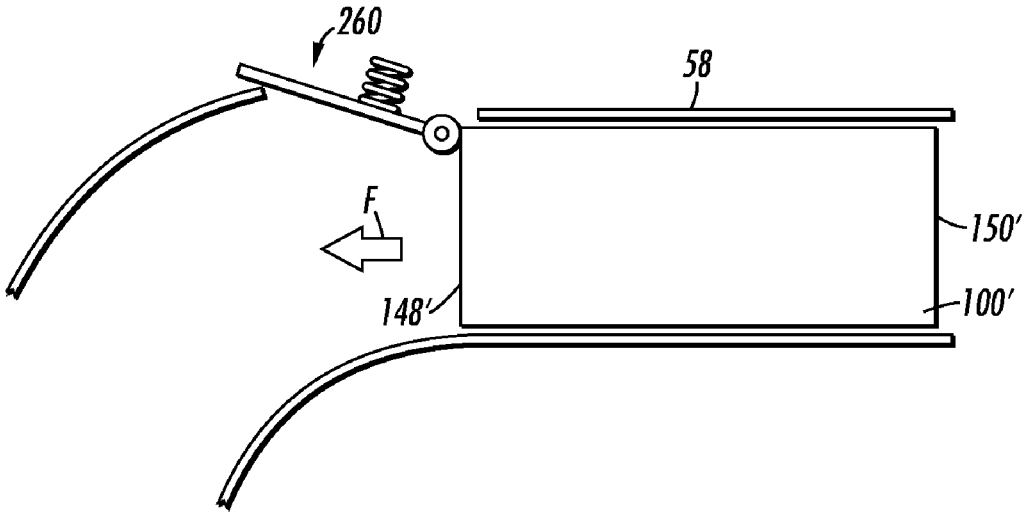
FIG. 17 is another side of the feed channel of FIG. 16.

In another embodiment, static constraints and strategic barriers may be incorporated into a single structure. Such a configuration may be beneficial at locations where the alignment and/or orientation of ink sticks is not fully influenced by the guide/support surfaces or elements of the feed channel such as in non-linear portions of the feed path. FIG. 16 is a side view of an embodiment of a feed channel 58 that includes a transition from a linear section to a downwardly arced section. In this embodiment, a barrier/constraint 260 is positioned at a point R on the top surface of the feed channel which corresponds to the transition from the linear portion of the channel to the arced portion of the channel. The barrier/constraint of FIG. 16 is configured for use with an ink stick having a clearance edge, or beveled edge, at the leading edge 148 adjacent the top surface of the ink stick. The barrier/constraint 260 comprises a spring loaded roller that is configured to lightly push against the clearance edge 200 of the ink stick, allowing it to pass. The clearance edge 200 engages the roller at an angle that allows the barrier/constraint to be moved upward thereby compressing the spring and allowing the barrier/constraint to move over the top surface of the ink stick. This interface may also beneficially push down on the leading edge of the stick to prevent it from hanging up on the general channel upper confines. However, as shown in FIG. 17, ink stick 100' having an abrupt leading edge 148, such as may be the case with improperly configured ink sticks and/or ink stick fragments, may engage the barrier/constraint 260 at an angle that does not allow for upward movement of the barrier/constraint 260 thereby blocking the passage of a potentially incompatible ink stick. Such sticks or stick pieces become more difficult to remove from the feed channel the further they progress so blockage at this point is more user friendly for retrieval.

Those skilled in the art will recognize that numerous modifications can be made to the specific implementations described above. Those skilled in the art will recognize that clearance edges, static constraints, and/or strategic barriers may have numerous shapes and configurations other than those illustrated. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A system for an ink delivery system of a phase change ink imaging device, the system comprising:

a feed chute having a first end configured to receive a solid ink stick and a second end positioned proximate a melting device to melt the solid ink stick, the feed chute being configured to guide at least one solid ink stick from the first end of the feed chute to the second end of the feed chute;

at least one sensor positioned proximate a portion of the feed chute between the first end of the feed chute and the second end of the feed chute, the at least one sensor being configured to detect a coded sensor feature of the solid ink stick as the solid ink stick moves from the first end of the feed chute to the second end of the feed chute; and a pair of nudgers, each nudger in the pair of nudgers being positioned on opposite sides of the feed chute and extending toward a middle of the feed chute, the pair of nudgers being positioned between the first end of the feed chute and the second end of the feed chute and the pair of nudgers being configured to orient the solid ink stick to enable the at least one sensor to detect the coded sensor feature of the solid ink stick at the portion of the feed chute between the first end of the feed chute and the second end of the feed chute.

2. The system of claim 1, the at least one sensor comprising at least one mechanically settable flag configured to be set by the coded sensor feature of the solid ink stick in response to the pair of nudgers orienting the solid ink stick at the at least one sensor.

3. The system of claim 1, the at least one sensor comprising an optical sensor configured to detecting the coded sensor feature of the solid ink stick optically.

4. The system of claim 3 further comprising:

a second pair of nudgers separated from each other by a longitudinal distance that is less than a length of the solid ink stick, the pair of nudgers and the second pair of nudgers being positioned beneath an opening in the feed chute at the first end of the feed chute to orient the solid ink stick with reference to an axis of insertion in response to the solid ink stick being imprecisely inserted through the opening in the feed chute.

5. The system of claim 4 further comprising:

an obstructor being positioned in the feed chute and extending between the pair of nudgers and the second pair of nudgers, the pair of nudgers and the second pair of nudgers being configured to guide ink sticks having a length greater than the longitudinal distance separating the pair of nudgers from the second pair of nudgers and the obstructor being configured to block passage of a solid ink stick having a length less than the longitudinal distance separating the pair of nudgers from the second pair of nudgers.

6. The system of claim 5, the obstructor being positioned with reference to a position of a breakage control feature of the solid ink stick, the breakage control feature being configured to facilitate breakage of the solid ink stick at a location that produces a leading ink stick piece and a trailing ink stick piece, the obstructor being positioned in the feed chute to block passage of a trailing ink stick piece of an ink stick separated at the breakage control feature in the solid ink stick.

7. A system for an ink delivery system of a phase change ink imaging device, the system comprising:

a feed chute having a first end configured to receive a solid ink stick and a second end positioned proximate a melting device to melt the solid ink stick, the feed chute being configured to guide at least one solid ink stick from the first end of the feed chute to the second end of the feed chute;

at least one sensor positioned proximate a portion of the feed chute between the first end of the feed chute and the second end of the feed chute, the at least one sensor being configured to detect a coded sensor feature of the solid ink stick as the solid ink stick moves from the first end of the feed chute to the second end of the feed chute; and at least one nudger comprising a roller that is positioned between the first end of the feed chute and the second end of the feed chute, the roller being configured to orient the solid ink stick to enable the at least one sensor to detect the coded sensor feature of the solid ink stick at the portion of the feed chute between the first end of the feed chute and the second end of the feed chute.

8. A system for an ink delivery system of a phase change ink imaging device, the system comprising:

a feed chute having a first end configured to receive a solid ink stick and a second end positioned proximate a melting device to melt the solid ink stick, the feed chute being configured to guide at least one solid ink stick from the first end of the feed chute to the second end of the feed chute;

at least one sensor positioned proximate a portion of the feed chute between the first end of the feed chute and the second end of the feed chute, the at least one sensor being configured to detect a coded sensor feature of the solid ink stick as the solid ink stick moves from the first end of the feed chute to the second end of the feed chute; and at least one nudger comprising a ramp-like projection that is positioned between the first end of the feed chute and the second end of the feed chute, the ramp-like projection being configured to orient the solid ink stick to enable the at least one sensor to detect the coded sensor feature of the solid ink stick at the portion of the feed chute between the first end of the feed chute and the second end of the feed chute.

9. An ink delivery system of a phase change ink imaging device, the system comprising:

a feed chute having a first end configured to receive solid ink sticks and a second end positioned proximate a melting device configured to melt solid ink sticks that travel from the first end of the feed chute to the second end of the feed chute, the feed chute being configured to guide solid ink sticks from the first end of the feed chute to the second end of the feed chute;

an opening at the first end of the feed chute, the opening being configured to receive ink sticks having a predetermined length;

an obstructor positioned proximate the opening in the first end of the feed chute, the obstructor being configured to block passage of ink sticks having a length less than a predetermined from the opening in the feed chute; and at least one pair of nudgers in the feed chute beneath the opening in the feed chute, the at least one pair of nudgers being configured to position a leading end of a solid ink stick having a length greater than the predetermined length beyond the obstructor to enable ink sticks having a length greater than the predetermined length to pass the obstructor and travel along the feed chute to the second end of the feed chute.

10. The ink delivery system of claim 9 further comprising:

at least one sensor positioned between the first end of the feed chute and the second end of the feed chute, the at least one sensor being configured to detect a coded sensor feature of the solid ink stick as the solid ink stick moves from the first end of the feed chute to the second end of the feed chute

11. The ink delivery system of claim 10, the at least one sensor comprising an optical sensor configured to detect the coded sensor feature of the solid ink stick optically.

12. The ink delivery system of claim 9, the at least one nudger comprising a roller.

13. The ink delivery system of claim 9, the at least one nudger comprising a ramp-like projection.

* * * * *